US011226107B1

(12) United States Patent
Nellis

(10) Patent No.: US 11,226,107 B1
(45) Date of Patent: Jan. 18, 2022

(54) OVEN DEBRIS COLLECTION SYSTEM

(71) Applicant: Wood Stone Corporation, Bellingham, WA (US)

(72) Inventor: Daric Nellis, Bellingham, WA (US)

(73) Assignee: Wood Stone Corporation, Bellingham, WA (US)

( * ) Notice: Subject to any disclaimer, the term of this patent is extended or adjusted under 35 U.S.C. 154(b) by 120 days.

(21) Appl. No.: 16/777,754

(22) Filed: Jan. 30, 2020

Related U.S. Application Data

(60) Provisional application No. 62/798,817, filed on Jan. 30, 2019.

(51) Int. Cl.
*F24C 15/14* (2006.01)
*F24C 15/00* (2006.01)

(52) U.S. Cl.
CPC ..... *F24C 15/14* (2013.01); *F24C 15/007* (2013.01)

(58) Field of Classification Search
CPC ..... F24C 15/14; F24C 15/007
See application file for complete search history.

(56) References Cited

U.S. PATENT DOCUMENTS

| | | | |
|---|---|---|---|
| 3,301,172 | A | 1/1967 | Haro |
| 3,349,726 | A | 10/1967 | Laszlo |
| 4,305,329 | A | 12/1981 | Fenoglio |
| 4,384,513 | A | 5/1983 | Pierick |
| 4,411,920 | A | 10/1983 | Fenoglio |
| 4,453,064 | A | 6/1984 | Toyoda et al. |
| 4,924,763 | A | 5/1990 | Bingham |
| 5,130,320 | A | 7/1992 | Getman et al. |
| 5,131,320 | A | 7/1992 | Jensen et al. |
| 5,205,274 | A | 4/1993 | Smith et al. |
| 5,254,823 | A | 10/1993 | McKee et al. |
| 5,315,922 | A | 5/1994 | Keller |
| 5,365,833 | A | 11/1994 | Chen |
| 5,398,666 | A | 3/1995 | Smith et al. |
| 5,492,055 | A | 2/1996 | Nevin et al. |
| 5,605,092 | A | 2/1997 | Riccio |
| 5,695,668 | A | 12/1997 | Boddy |
| 5,945,023 | A | 8/1999 | Yang |
| 6,080,496 | A | 6/2000 | Hupf et al. |
| 6,146,677 | A | 11/2000 | Moreth |
| 6,222,163 | B1 | 4/2001 | Arntz et al. |
| 6,250,210 | B1 | 6/2001 | Moreth |
| 6,425,388 | B1 | 7/2002 | Korinchock |

(Continued)

FOREIGN PATENT DOCUMENTS

| | | | |
|---|---|---|---|
| BR | PI1107198 | A2 | 10/2013 |
| CN | 201710175 | U | 1/2011 |

(Continued)

OTHER PUBLICATIONS

International Searching Authority, International Search Report, PCT/US2014/035044, dated Sep. 25, 2014, 3 pages.

*Primary Examiner* — David J Laux
(74) *Attorney, Agent, or Firm* — Schacht Law Office, Inc.; Dwayne Rogge

(57) ABSTRACT

An oven debris collection system configured to be mounted to an oven wherein the debris collection system provides a shelf that food items may be placed on as they are placed in the oven or removed therefrom. The oven debris collection system having a perforated shelf surface, and at least one removable debris tray there below to catch and retain the debris.

6 Claims, 5 Drawing Sheets

(56) References Cited

U.S. PATENT DOCUMENTS

| | | | | |
|---|---|---|---|---|
| 6,745,758 | B1 | 6/2004 | Minidis | |
| 7,357,131 | B2 | 4/2008 | Moreth, III et al. | |
| 7,759,617 | B2 | 7/2010 | Bowles et al. | |
| 8,042,458 | B2 * | 10/2011 | Ueda | A21B 3/04 99/476 |
| 8,181,640 | B2 | 5/2012 | Park | |
| 8,291,896 | B1 | 10/2012 | Gonnella et al. | |
| 8,624,166 | B2 | 1/2014 | Moreth, III | |
| 8,948,579 | B2 | 2/2015 | Lee | |
| 9,182,129 | B2 | 11/2015 | Dahle et al. | |
| 9,795,147 | B2 | 10/2017 | Hegarty et al. | |
| 10,420,347 | B2 | 9/2019 | Hegarty et al. | |
| 2002/0088111 | A1 | 7/2002 | Arx et al. | |
| 2002/0130190 | A1 | 9/2002 | Marbach et al. | |
| 2004/0211406 | A1 | 10/2004 | Cornfield | |
| 2006/0090741 | A1 | 5/2006 | Bowles et al. | |
| 2007/0108177 | A1 | 5/2007 | Engelhardt | |
| 2010/0209083 | A1 | 8/2010 | Lee | |
| 2011/0048244 | A1 | 3/2011 | Wiker | |
| 2020/0015484 | A1 | 1/2020 | Hegarty et al. | |

FOREIGN PATENT DOCUMENTS

| | | | |
|---|---|---|---|
| CN | 101686777 | B | 11/2014 |
| CN | 105143772 | B | 11/2018 |
| CN | 109589003 | A | 4/2019 |
| EP | 0781072 | A1 | 6/1997 |
| EP | 2989390 | A4 | 12/2016 |
| GB | 623040 | A | 5/1949 |
| IN | 9111DELNP2015 | | 10/2015 |
| JP | 2008541988 | A | 11/2008 |
| JP | 2016509152 | A | 3/2016 |
| MX | 372139 | | 10/2015 |
| MX | 2015014705 | A | 6/2016 |
| RU | 2052175 | C1 | 1/1996 |
| RU | 24357 | U1 | 8/2002 |
| SU | 1296111 | | 3/1987 |
| WO | 1992020232 | A1 | 11/1992 |
| WO | 2006132904 | A2 | 12/2006 |
| WO | 2010080160 | A1 | 7/2010 |
| WO | 2014176285 | A1 | 10/2014 |

* cited by examiner

OVEN DEBRIS COLLECTION SYSTEM

RELATED APPLICATIONS

This application claims priority of U.S. Provisional Patent Application Ser. No. 62/798,817 filed on Jan. 30, 2019 incorporated herein by reference.

BACKGROUND OF THE DISCLOSURE

Field of the Disclosure

This disclosure relates to the field of debris collection devices attached to cooking ovens for household and industrial applications.

BRIEF SUMMARY OF THE DISCLOSURE

Disclosed herein in one example is an oven debris collection system configured to be mounted to an oven with a housing, cooking chamber, cooking surface and a doorway, the oven debris collection system comprising: a frame configured to be mounted to the exterior of an oven; a shelf panel attached to the frame, the shelf panel having and upper surface substantially contiguous with the cooking surface; the shelf panel being perforated with perforations through which food debris may pass; and at least one removable debris tray below the shelf panel to catch and retain the debris passing through the perforations.

The oven debris collection system as recited herein may further comprising an open region transversely outward of the shelf panel relative to the doorway through which debris may pass into the debris tray.

The oven debris collection system may be arranged wherein the debris tray further comprising a front panel having an upper edge laterally even with the upper surface of the shelf panel.

DETAILED DESCRIPTION OF THE DISCLOSURE

Figure 1:
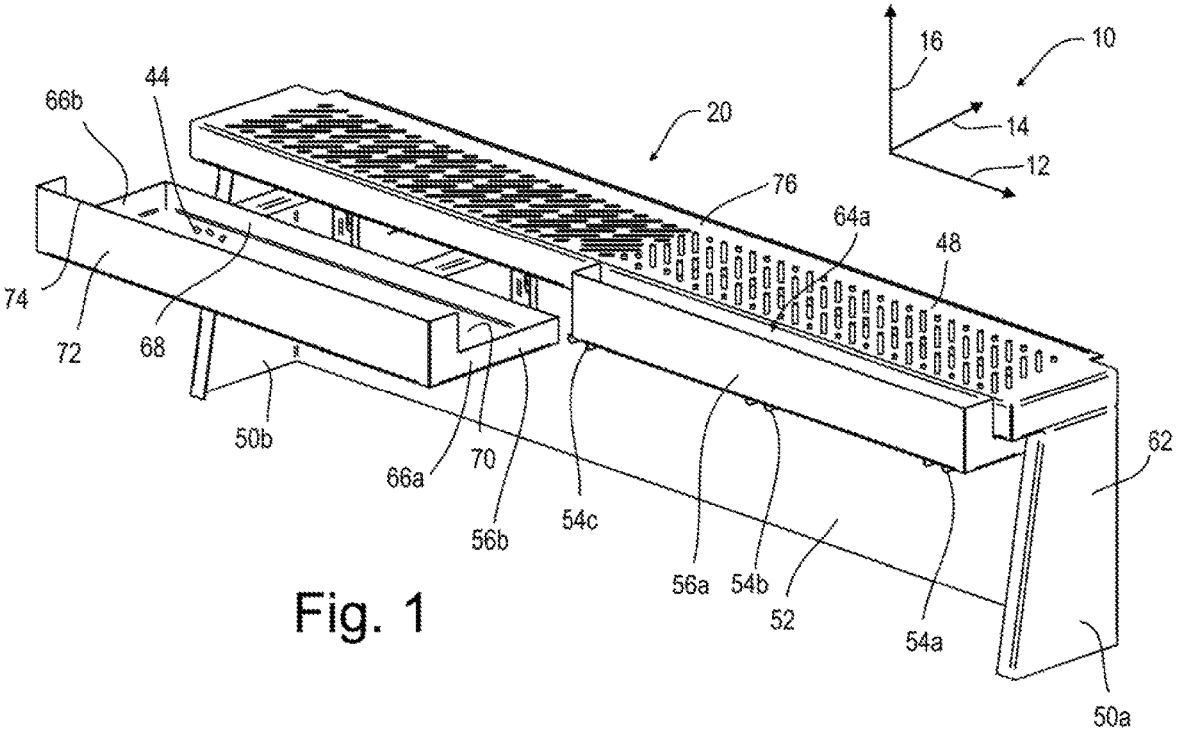
FIG. 1 is a front perspective view of one example of the disclosed oven debris collection system.
Figure 2:
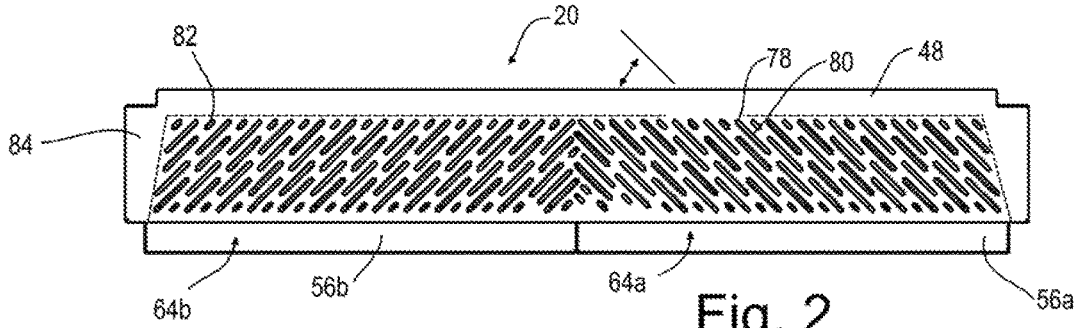
FIG. 2 is a top view of the debris collection system shown in FIG. 1.
Figure 3:
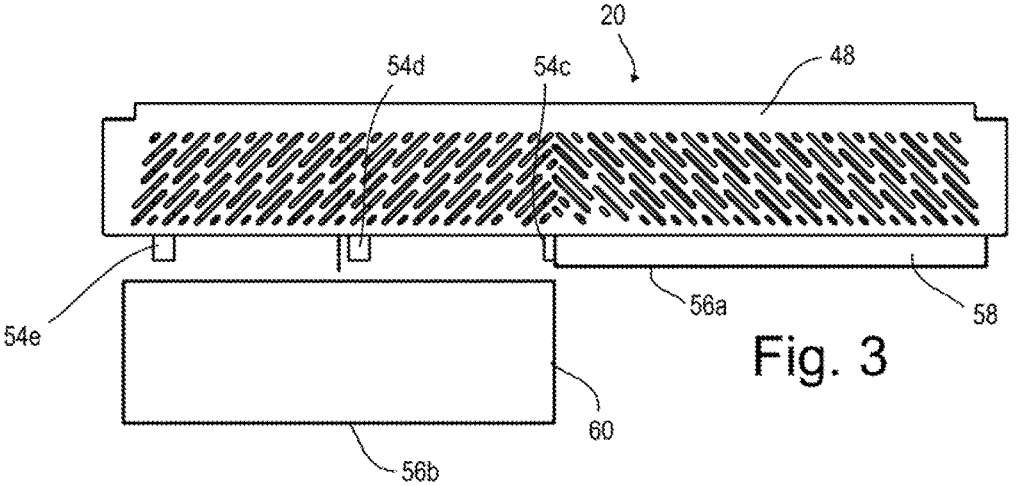
FIG. 3 is a top view of the debris collection system shown in FIG. 1.

This disclosure relates to the field of cooking, and specifically baking. In one example the apparatus disclosed herein is particularly useful in the baking of pizzas, breads, and other food goods where it is common to place an uncooked food item into an oven, and during the cooking process food particles become detached from the food item. In examples where the food good is placed directly on the cooking surface of the oven, and not on a pan or plate interposed between the food good and the oven surface, these food particles accumulates in the oven. These detached food particles become debris, not normally desired. Due in part to the relatively small size of the food particles, the detached food particles become dry, potentially burned, and generally not longer palatable. Periodically these food particles are swept or otherwise removed from the oven, normally through the doorway of the oven, or via a perimeter debris tray. Food particles also are removed as the food item is removed from the oven as they are attached to the food item, cooking utensil, or dragged thereby.

For these reasons, catch trays are often provided, such as shown in U.S. Pat. Nos. 9,795,147 and 5,254,823 incorporated herein by reference. Such debris trays normally are open on top, and thus hinder operation of the oven as food items are placed in the oven and removed therefrom.

Thus, is disclosed an oven debris collection system 20 configured to be mounted to an oven 22 wherein the debris collection system provides a shelf that food items may be placed on as they are placed in the oven 22 or removed therefrom. The oven debris collection system 20 in one example having a wireframe, grid, or perforated shelf surface, and at least one removable debris tray there below to catch and retain the debris.

Figure 4:
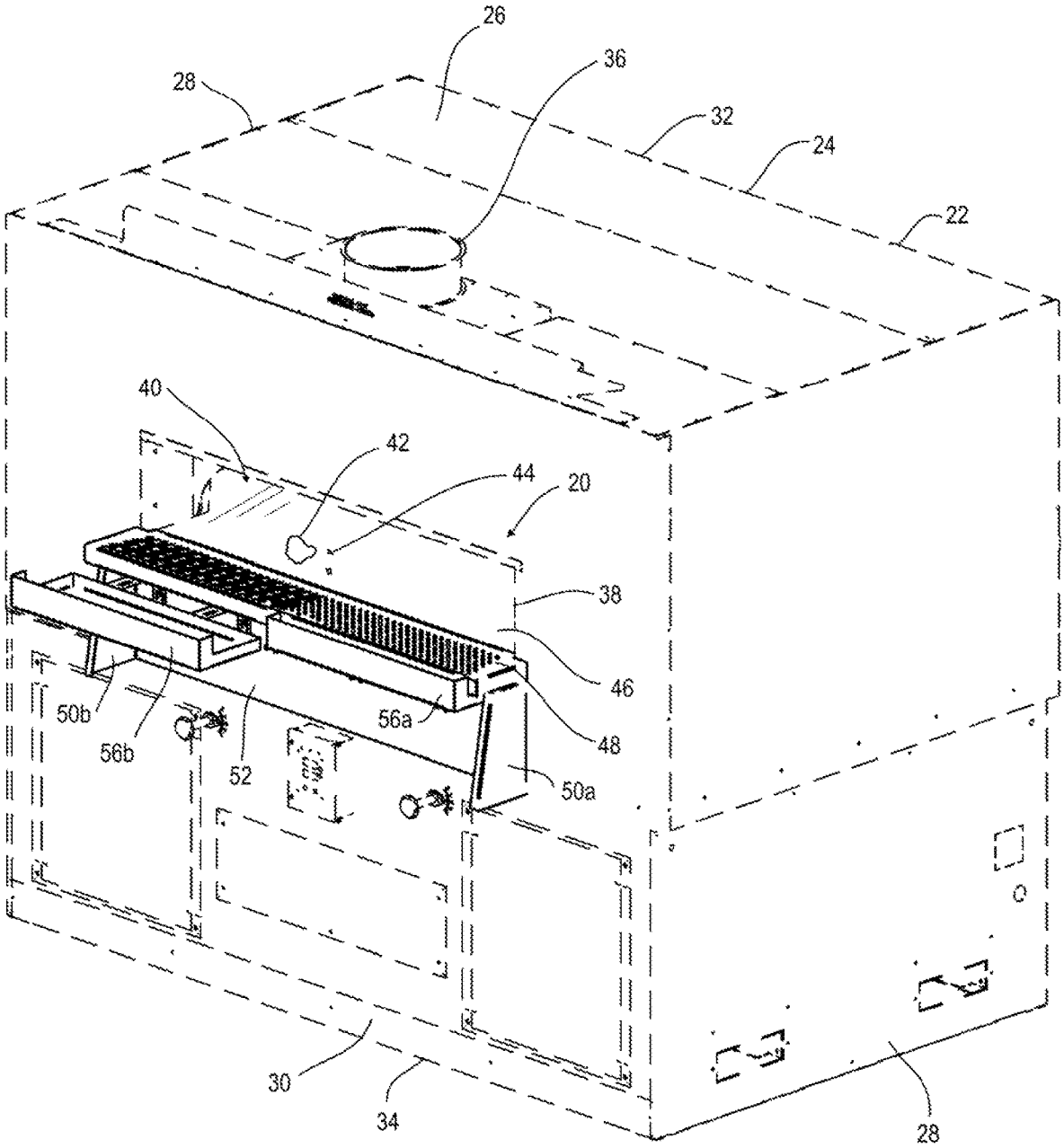
FIG. 4 is a front perspective view of the debris collection system shown in FIG. 1, attached to an oven.
Figure 5:
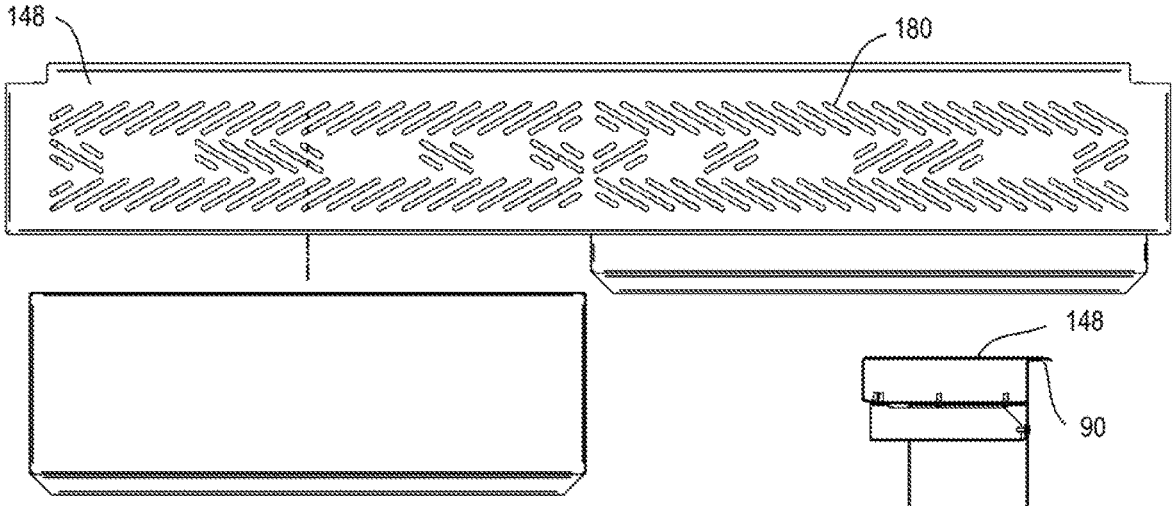
FIG. 5 is a top view of another example of the debris collection system with one tray partially removed.

Before continuing, an axes system 10 is disclosed for ease in describing the debris collection system 20 and its components. The axes system 10 comprising a longitudinal axis 12 aligned with the long axis of the shelf panel 48 and the width of the doorway 38. The axes system 10 also comprising a transverse axis 14 orthogonal to the longitudinal axis 12 and the front of the oven 22. The axes system also including a lateral axis 16 orthogonal to the longitudinal axis 12 and the transverse axis 14.

Where the debris collection system 20 is configured to be mounted to an oven 22, FIG. 4 shows one highly schematic example of an oven 22. The oven 22 comprising an outer shell or housing 24 surrounding the inner components and forming a structure to which the debris collection system 20 is attached. The housing 24 of this example having a top 26, sides 28, a front 30, rear 32 and a bottom 34. A vent 36 may be provided to allow gasses, odors, and excessive heat to escape. The housing 24 having a surface defining the doorway 38 therethrough. The doorway 38 providing access to the cooking chamber 40 of the oven 22 within which food items 42 are heated and cooked. As the food items are cooked, and as they are moved, food particles break off the food items 42 and thus form debris 44. The debris 44 may also comprise particles from cooking implements, contaminates such as air contaminates (dust) and heating residuals (soot) are deposited on the cooking surface upon which the food item 42 is placed for cooking. For example, wooden paddles used for placing and removing pizzas from an oven are known to splinter and result in debris 44.

In one example, the cooking surface 46 within the cooking chamber 40, within the housing 24 of the oven 22 is substantially continuous (flat, level, planar) with a shelf panel 48 of the debris collection system 20. In such an example, the cooking surface 46 is substantially vertically aligned with the shelf panel 48, with little or no gap therebetween. The shelf panel 48 in one example is at least substantially exterior of the doorway 38, thus exterior of the cooking chamber 40.

To collect this debris 44 from accumulating on the shelf panel 48 or falling onto the floor beneath the oven doorway 38, a collection system has been devised as shown herein. The debris collection system 20 comprising in one example a plurality of side brackets 50 (50*a*, 50*b*) on either longitudinal end thereof. The side brackets 50 in one example are attached to the front 30 of the oven housing 24 adjacent the doorway 38 where the shelf panel 48 is supported by the side brackets 50.

Also shown is an example utilizing a rear bracket 52 connecting the side brackets 50*a*, 50*b* and supporting the shelf panel 48 between the side brackets 50*a*, 50*b*. In one example the rear bracket 52 also supports one or more tray supports 54 (54*a*-54*e*) upon which the removable debris trays 56 (56*a*, 56*b*) rest and/or slide from a first position 58 where they are beneath the shelf panel 48 transversely outward to a second position 60 where they may be accessible for removal of the debris 44 by vacuuming, wiping. From this second position 60, the debris trays 56 may also be completely removed from the frame 62, thus enabling inversion, dumping, and further cleaning of the tray 56. The tray 56 may be re-inserted in the frame 62 (including brackets 50/52, supports 54) and the debris collection system 20 is again ready for use to collect debris 44. In one example the shelf panel 48 is removable from the frame 62. In another example the shelf panel 48 is fixed to the frame 62 by way of fasteners, welding, or formed as a unitary structure with other components of the frame 62 by bending or other construction methods.

In operation, as debris 44 is swept from the cooking surface 46 through the doorway 38 during cleaning or through entry and removal of food or cooking implements or air currents etc. from the cooking chamber 40, the food particles, debris 44 are swept onto the shelf panel 48 and pass vertically downward by gravity through perforations or gaps around the perimeter of the shelf panel 48 onto/into the removable debris trays 56. This collects the debris 44 in a controllable and easily cleanable system.

In addition, the example debris collection system 20 shown also comprises an open region or gap 64 (64*a*, 64*b*) transversely outward of the doorway 38, such that debris 44 passing the shelf panel 48 which does not pass through other gaps nor the perforations 80 will fall into the debris tray 54 through the open region 64.

In one example, each debris tray 56 comprises a plurality of side panels 66 (66*a*, 66*b*), a rear panel 68, a bottom panel 70, and a front panel 72 such that debris is retained in the debris tray 56.

In one example, the front panel 72 of each debris tray 56 has an upper edge 74 in the plane of the upper surface 76 of the shelf panel 48. Thus, food and cooking implements resting partially on the upper edge 74 and bridging to the shelf panel 48 will be stable. In this configuration, the front panel 72 will not hinder insertion and removal of food items 42 to the cooking chamber 40, and the upper edge 74 is efficient in capturing debris 44 from falling past the front panel 72. In one example, as shown, the front panel 72 is considerably higher than the side panels 66 In one example, the front panel 72 is considerably higher than the rear panel 68.

In one example, the shelf panel 48 comprises a multitude of surfaces 78 forming perforations 80 through the shelf panel 48 to allow debris 44 to pass there though and keep the shelf panel 48 substantially clean and clear of debris 44. In the example shown, the shelf panel 48 comprises one or more perforated region(s) 82 and one or more non-perforated region(s) 84.

In one example, the surface area of the shelf panel 48 in the perforated region 82 is less than the area of the perforations 80 in the perforated region 82. In other terms, the perforations 80 cover more than half the surface area of the upper surface area of the shelf panel 48.

Figure 7:
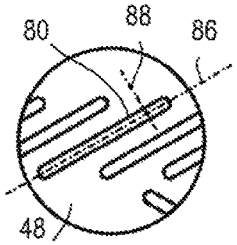
FIG. 7 is an enlarged view of the region 7 of FIG. 6.
Figure 6:
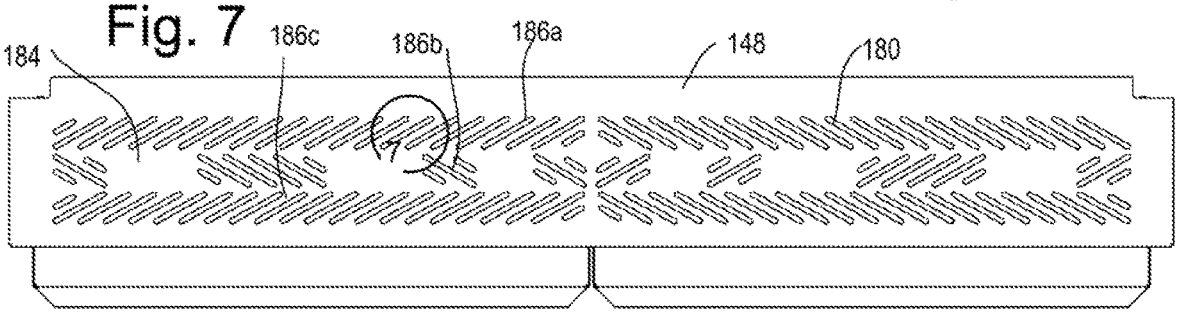
FIG. 6 is a top view of the example of the debris collection system shown in FIG. 5 with each tray fully inserted.
Figure 8:
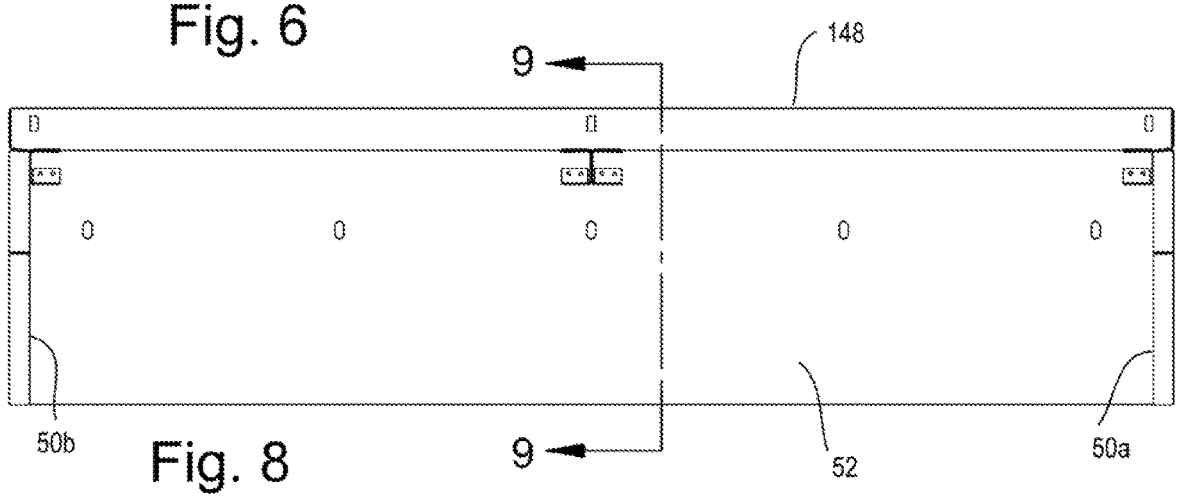
FIG. 8 is a front view of the example shown in FIG. 5 with both debris trays removed.
Figure 10:
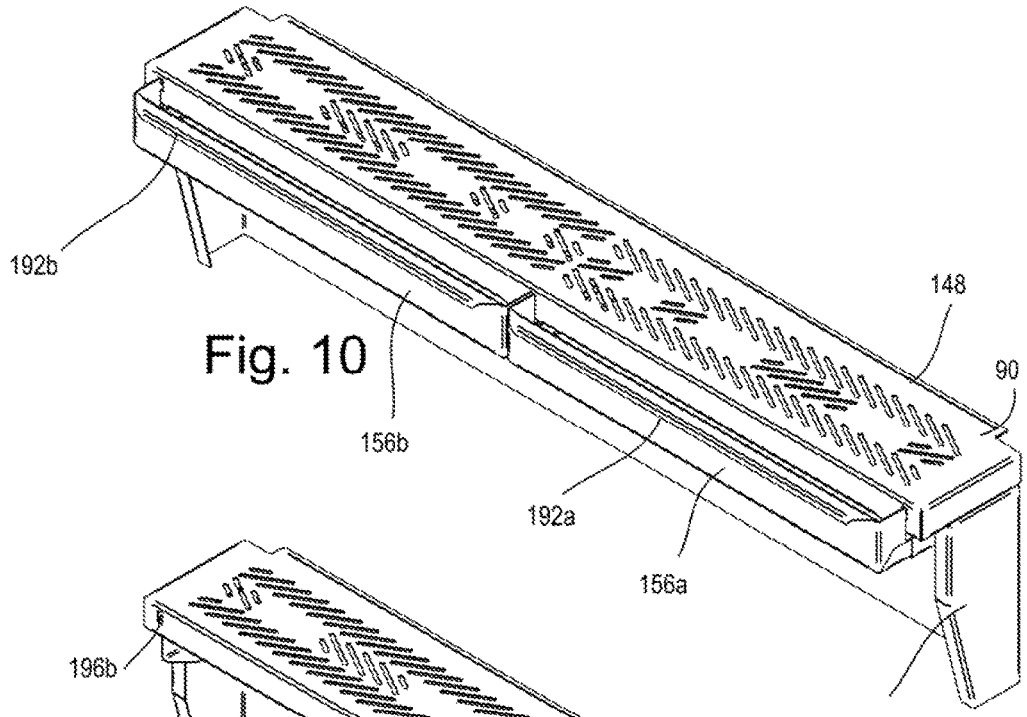
FIG. 10 is an isometric view of the example shown in FIG. 5.
Figure 11:
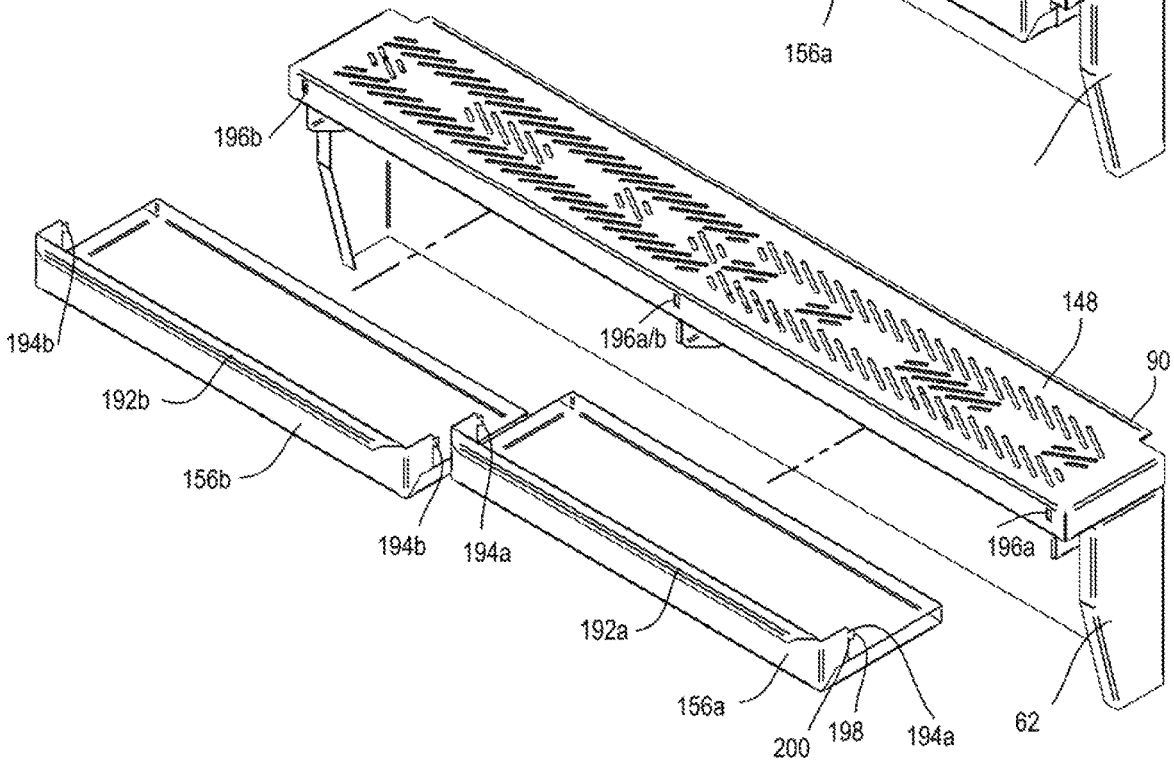
FIG. 11 shows the example of FIG. 10 with both debris trays removed from the frame.
Figure 12:
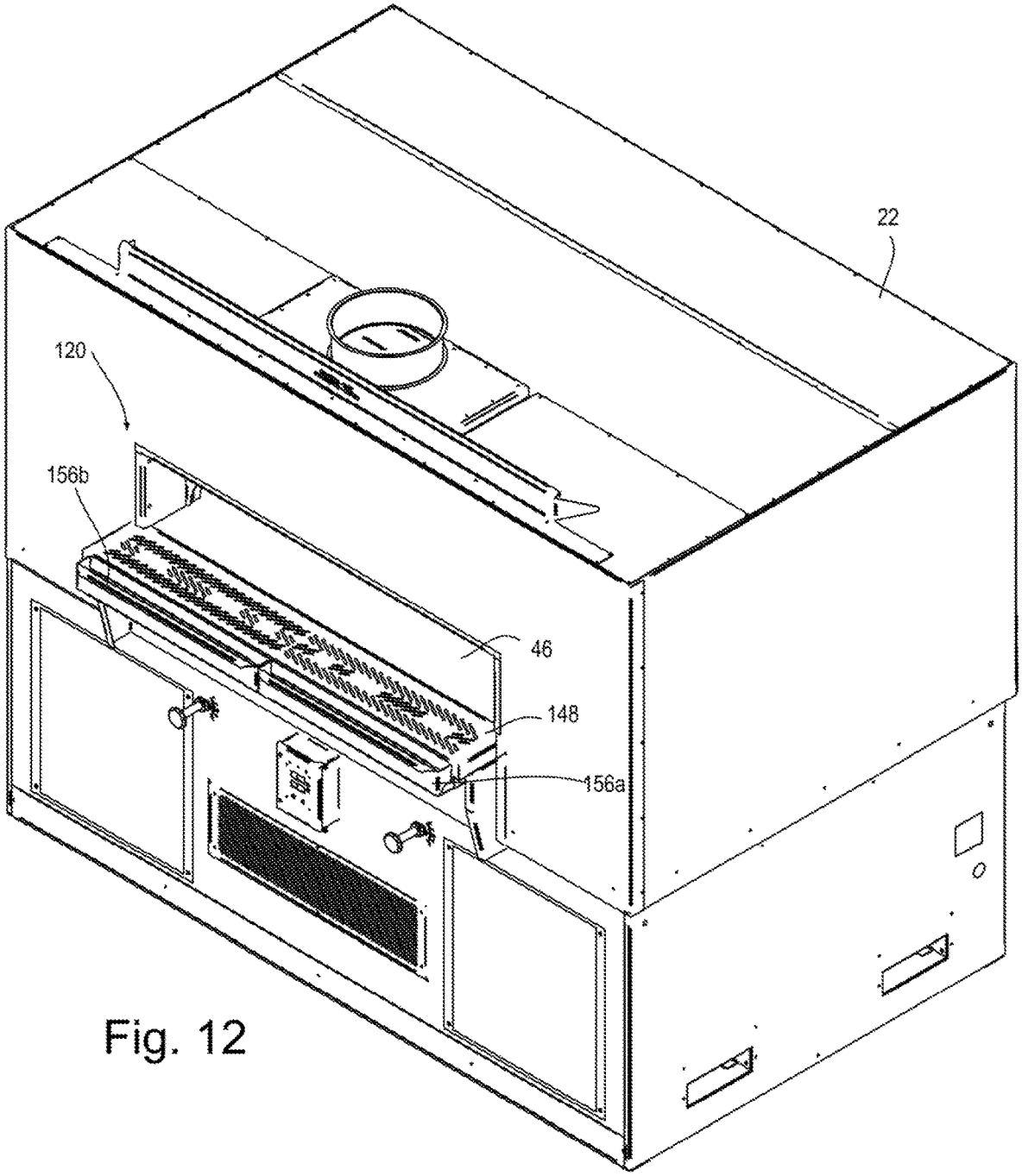
FIG. 12 shows the example of FIG. 5 attached to an oven.

In one example as labeled in FIG. 7, the perforations 80 are elongated voids, being longer in a longer or first axis 86 in the plane of the shelf panel 48 than in a transverse or second axis 88 orthogonal to the first axis in the plane of the shelf panel 48.

FIGS. 5-12 show another example of the debris collection system. This example of the debris collection system 120 mounted to an oven 22 equivalent to that shown in the first example.

In this second example, the shelf panel 148 is of a slightly different design. In this example, the long axis 186*a* of the perforations 180 closest to the oven 22 are aligned greater than 90° from the long axis 186*b* of perforations slightly outward therefrom. A third row or set of perforations has a long axis 186*c* greater than 90° from the long axis 186*b* of the second row. In one example. The long axes 186*a* and 186*c* are parallel.

This example also included non-perforated regions 184 upon which food items or cooking implements may be placed without danger of passing through the perforations 180.

Figure 9:
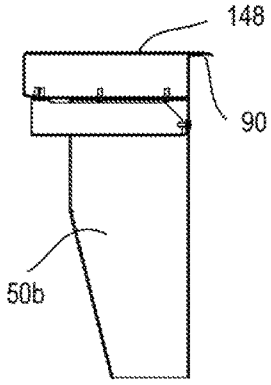
FIG. 9 is a cutaway view taken along line 9-9 of FIG. 8.

The example shown in FIG. 9 also includes a lip 90 which extends into the doorway 38 into the oven 22. This lip substantially hinders debris 44 from being deposited into a gap between the shelf panel 48/148 and the cooking surface 46.

This example also may include a forward protruding lip 192 (192*a*, 192*b*) on each debris tray 156 (156*a*, 156*b*). This protruding lip 192 being easily grasped by a user to pull the debris tray 156 from the frame and may also provide additional resting space for food or cooking implements at the shelf panel 148.

In one example, the debris trays 196 include tabs 194 at either end thereof. These tabs 194 insert into corresponding holes 196 in the frame 62. In one example, each tab 194 comprises a protrusion portion 198 which is inserted into the corresponding hole 196 and a cutout 200 which allows the protrusion 198 to drop downward into the hole 196 and thus hold the debris tray 156 in pace against the frame 62 until the debris tray 156 is lifted and removed.

Many of the components disclosed herein, including the shelf panel 48, trays 56, and frame 62 may be made of metal panels, including stainless steel.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. An oven debris collection system configured to be mounted to an oven with a housing, cooking chamber, cooking surface and a doorway, the oven debris collection system comprising:

a frame configured to be mounted to the exterior of an oven;

a shelf panel attached to the frame;

the shelf panel having and having an upper surface substantially contiguous with the cooking surface;

the shelf panel comprising perforations through which food debris may pass; and at least one removable debris tray removably attached to the frame below the shelf panel to catch and retain the debris passing through the perforations.

2. The oven debris collection system as recited in claim 1 and further comprising an open region transversely outward of the shelf panel relative to the doorway through which debris may pass into the debris tray.

3. The oven debris collection system as recited in claim 1, the debris tray further comprising a front panel having an upper edge laterally even with the upper surface of the shelf panel.

4. The oven debris collection system as recited in claim 1, wherein the shelf panel comprises:

a protrusion extending substantially the longitudinal width of the shelf panel; and the protrusion extends transversely past the frame into the oven.

5. The oven debris collection system as recited in claim 1, the debris tray further comprising a locking system comprising at least one protrusion extending into a surface defining a hole in the frame.

6. The oven debris collection system as recited in claim 1, each at least one protrusion extending into a surface defining a hole in the frame comprises a protrusion and a cutout which allows the protrusion to drop downward into the hole and thus hold the debris tray in pace against the frame until the debris tray is lifted and removed from the frame.

* * * * *